United States Patent [19]

House et al.

[11] Patent Number: 4,643,505

[45] Date of Patent: Feb. 17, 1987

[54] EXTENSION CORD CONNECTOR HOUSING

[75] Inventors: David N. House, Irving; Blas O. Sauseda, Desoto, both of Tex.

[73] Assignee: Tri-Cities Tool & Die Clinic, Inc., Dallas, Tex.

[21] Appl. No.: 336,369

[22] Filed: Dec. 31, 1981

Related U.S. Application Data

[63] Continuation of Ser. No. 203,133, Nov. 3, 1980, abandoned.

[51] Int. Cl.[4] ..... H01R 13/58

[52] U.S. Cl. ..... 339/75 P

[58] Field of Search ..... 339/39, 75 R, 75 P

[56] References Cited

U.S. PATENT DOCUMENTS

| | | | |
|---|---|---|---|
| 2,569,037 | 9/1951 | Dalton | 339/75 P |
| 2,761,112 | 8/1956 | Torcivina | 339/39 |
| 3,344,393 | 9/1967 | Hendee | 339/75 P |

*Primary Examiner*—Joseph H. McGlynn

*Attorney, Agent, or Firm*—Jerry W. Mills; Gregory M. Howison

[57] ABSTRACT

A housing (18) is provided for maintaining the plugs (14, 16) of a pair of extension cords (10, 12) connected. The housing (18) includes first and second members (24, 26) which are connected by a hinge (28) along one edge. The interior surfaces (38, 44) of each of the first and second members (24, 26) include a series of grooves (54, 56) distributed along the length of the members. Retaining washers (30, 32) are designed to be engageable with the grooves (54, 56) to hold the plugs of a connected pair of extension cords in engagement. The provision of a series of grooves (54, 56) permits the housing (18) to be adapted for use with a wide range of plug lengths. The slots (88) in the retaining washers (30, 32) are designed so that the cable passing therethrough is slightly offset from the central axis to resist motion in the plugs. After the retaining washers have been positioned in the first and second members, the first and second members are pivoted about the hinge into abutting relationship and maintained therein by flexible hooks (78, 80) to form a capsule having a streamlined shape which resists entanglement in obstructions during use.

6 Claims, 5 Drawing Figures

EXTENSION CORD CONNECTOR HOUSING

This is a continuation of application Ser. No. 203,133, filed Nov. 3, 1980, now abandoned.

TECHNICAL FIELD

This invention relates to the interconnection of extension cords, and more particularly to maintaining the connection between plugs of extension cords.

BACKGROUND ART

The interconnection of several flexible extension cords to transmit power from a source, such as an electrical outlet, to a device is very common. In a household environment, several extension cords may be interconnected to provide power to a device, such as a lawnmower or hedge trimmer for use at a distance from a power outlet. Interconnected extension cords may also be used in commercial applications, particularly by construction workers operating hand tools or other devices operated remotely from a power outlet.

The typical extension cord includes male and female plugs interconnected by a flexible cable. In many extension cords, the female plug of one cord is connected to the male plug of another cord by receiving spade type conductors from the male plug and urging internal conductors in contact therewith. On many occasions, the application of tension to a cable of a connected pair of extension cords will induce separation or disconnection of the conductors in the plugs and prevent the transmission of power. This naturally results in inconvenience and expense caused by the necessity to reconnect the plugs.

In the past, several attempts have been made to alleviate this problem. The connected extension cords may be tied in a knot adjacent the plugs. However, this causes fatigue in the cable and may result in cord failure. Examples of other attempts are disclosed in U.S. Pat. Nos. 4,143,934 to Siebert issued Mar. 13, 1979, 3,344,393 to Hendee, issued Sept. 26, 1967, 3,059,209 to Bird, issued Oct. 16, 1962 and 3,014,194 to Berglund, issued Dec. 19, 1961.

While the devices disclosed in the above referenced patents have been effective in certain circumstances, there remains a need for a lightweight, inexpensive device for maintaining the connection between extension cords. In particular, it would be most desirable to provide a device performing this function which is adaptable for use with a wide cross section of the multitude of extension cord plug designs currently available.

DISCLOSURE OF INVENTION

In accordance with the present invention, a housing for maintaining the interconnection between the plugs on a pair of extension cords is provided. The housing includes a first member having a generally elongate hemi-cylindrical shape about a central axis, the interior surface of the first member defining a plurality of grooves spaced along the first member in the elongate direction and extending generally perpendicular to the central axis of the member. A second member is provided about a central axis also having a generally elongate hemi-cylindrical shape with an interior surface defining a plurality of grooves spaced along the member in the elongate direction and extending generally perpendicular to the central axis. A hinge member is provided which interconnects the first and second members along edges in the elongate direction, the first member having at least one flexible hook adjacent the opposite edge of the member for engaging the opposite edge of the second member adjacent its opposite edge to secure the members in abutting relationship to form a capsule for enclosing the plugs of the extension cords with the grooves in each of the members being aligned. First and second retaining washers are provided, each being engageable with the aligned grooves in the first and second members to secure the washers therein. Each of the first and second retaining washers is provided with a slot formed therein for passage of the cable of an extension cord. The retaining washers are positioned on opposite sides of the interconnected plugs of the extension cords to prevent disconnection of the plugs, the retaining washers being selectively engageable with the grooves to permit the use of the housing with plugs of varied length.

In accordance with another aspect of the present invention, a housing for maintaining the interconnection between the plugs on a pair of extension cords is provided which includes first and second members having a generally elongate hemi-cylindrical shape formed of injection molded plastic and interconnected with an integral or living hinge. The ends of each of the first and second members may be tapered at their ends in the elongate direction to define ports for passage of the cable of the extension cord. The retaining washers are offset to resist movement of the plugs within the housing.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
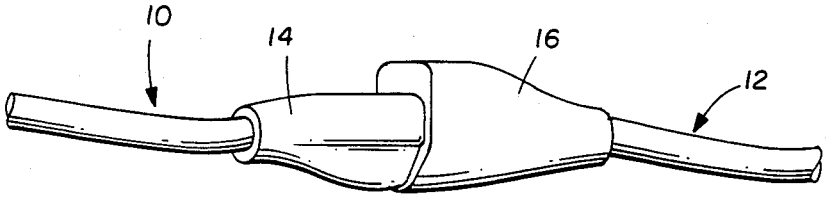
FIG. 1 is a perspective view the interconnected plugs of a pair of extension cords.

Referring now to the Drawings, wherein like reference characters designate like or corresponding parts throughout several views, FIG. 1 illustrates a pair of extension cords 10 and 12 interconnected by the male plug 14 of extension cord 10 and the female plug 16 of extension cord 12. In the typical application, the male plug 14 includes protruding conductors commonly having a spade or rod-like shape. The protruding conductors of the male plug 14 are inserted in the female plug 16 and a conductor within the female plug 16 is urged into contact with each conductor of the male plug 14.

Figure 2:
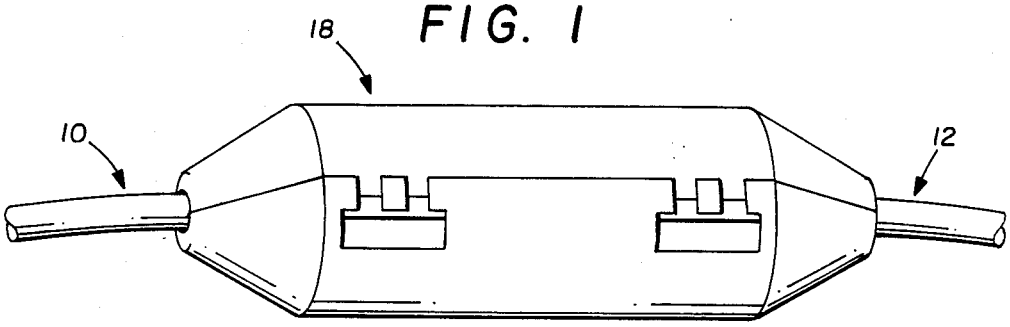
FIG. 2 is a perspective view of the housing forming the present invention maintaining the connection between a pair of extension cords.

FIG. 2 illustrates a housing 18 forming the present invention which surrounds the interconnected plugs 14 and 16 of the extension cords 10 and 12 and maintains the plugs interconnected in a manner discussed hereinafter. The streamline exterior of the housing 18 permits the housing to be pulled through obstructions such as weeds or shrubs without becoming hooked or tangled in the obstruction, thereby necessitating the inconvenience of untangling the housing from the obstruction.

Figure 3:
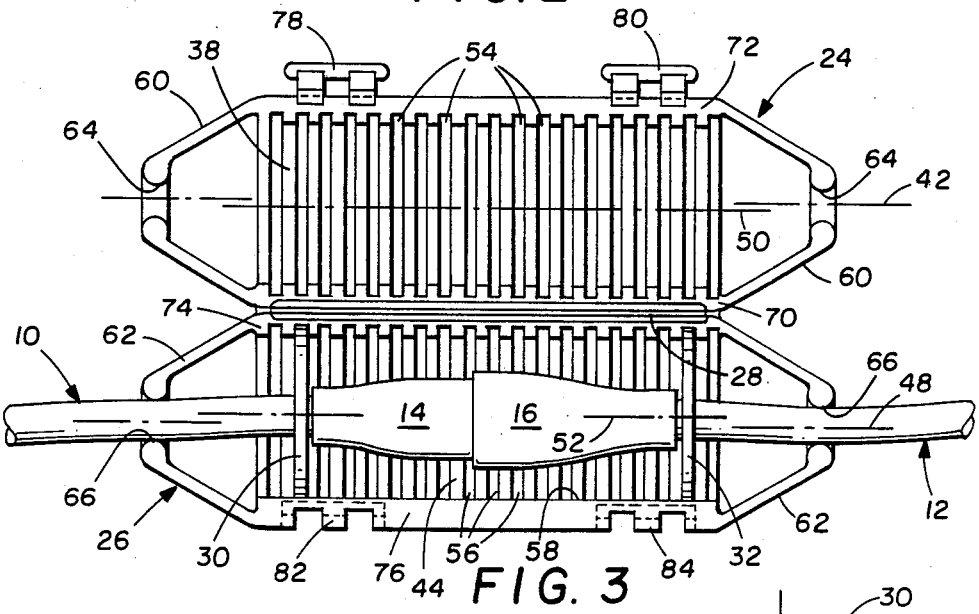
FIG. 3 is a plan view of the first and second members of the housing showing the placement of the retaining washers in the grooves of a member to maintain the plugs interconnected.
Figure 4:
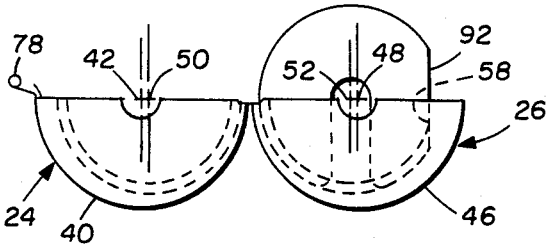
FIG. 4 is an end view of the first and second members illustrating a retaining washer positioned in one member with the cable of one extension cord passing therethrough.
Figure 5:
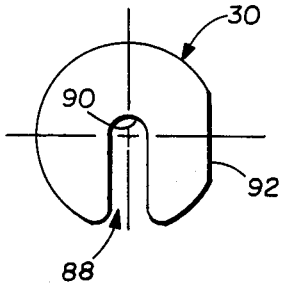
FIG. 5 is a plan view of a retaining washer for use in the present invention.

With reference now to FIGS. 3–5, the housing 18 generally comprises a first member 24, a second member 26 interconnected with first member 24 by a hinge 28 and retaining washers 30 and 32. In the preferred embodiment, the first and second members 24 and 26 and hinge 28 are formed in an integral unit from an injection molded plastic. The hinge 28 therefore is of the type known as a "living" hinge. The retaining washers 30 and 32 may also be formed of plastic in the preferred embodiment.

As is apparent with reference to FIGS. 3 and 4, the first member 24 and second member 26 have an elongate hemi-cylindrical shape. The interior surface 38 and exterior surface 40 of the first member 24 have a curvilinear shape with a radius centered on central axis 42. The interior surface 44 and exterior surface 46 of second member 26 are also curvilinear and have a radius centered on central axis 48. The central portion of the first member 24 includes a purality of grooves 54 formed along the interior surface 38 in the elongate direction. The grooves generally have a uniform depth and are curvilinear about a radius centered on axis 50 slightly offset from central axis 42 and extend generally perpendicular to the central axis. The second member 26 also has grooves 56 formed in its central portion in a similar manner about a radius centered on axis 52 slightly offset from central axis 48. However, each of the grooves 56 includes a flatened portion 58 as illustrated in FIG. 4 for preventing rotation of the retaining washers 30 and 32 in a manner described hereinafter. It can be seen with reference to FIG. 3 that individual grooves 54 and 56 are aligned in a plane perpendicular to the central axes 42 and 48.

The first member 24 and second member 26 are formed with ends 60 and 62 in the elongate direction. The ends 60 and 62 are tapered toward the central axes 42 and 48, respectively, to provide a streamline shape to the exterior of housing 10. The outermost extent of ends 60 define a curved surface 64 curved in two directions to form semi-circular ports. The outermost extent of end 62 form curved surfaces 66 also curved in two dimensions to form semi-circular ports.

The first member 24 includes an inner edge 70 and an outer edge 72. Both inner edge 70 and outer edge 72 lie generally in the same plane which includes the central axis 42 and axis 50. The second member 26 includes an inner edge 74 and an outer edge 76. Both inner edge 74 and outer edge 76 lie in a plane containing the central axis 48 and axis 52. As is apparent from FIG. 2, if the first and second members 24 and 26 are pivoted about the hinge 28 so that the inner edge 70 of first member 24 and inner edge 74 of second member 26 are abutting and the outer edge 72 of first member 24 and outer edge 76 of second member 26 are abutting, the first and second members 24 and 26 form a capsule for enclosing the plugs of the extension cords. Extensions 78 and 80 are formed on the outer edge 72 of first member 24 to engage flexible hooks 82 and 84 formed in the exterior surface 46 of the second member 26 to maintain the first and second members 26 in the position shown in FIG. 2.

The retaining washer 30, as illustrated in FIG. 5, is disc shaped, having a generally uniform thickness and a circular circumference. A slot 88 of uniform width is formed in the retaining washer 30 and extends radially inward from the outer circumference and through the center of washer 30. The interior end of slot 88 is formed by a semicircular surface 90 having a radius centered coincident with the center of the radius of the outer circumference of the washer 30. The width of slot 88 and radius of surface 90 are designed to be sufficiently large to permit the cable of the extension cords used with the present invention to be slid into slot 88 and centered at the center of the radius of curvature of the other circumference of the washer 30. Portion 92 of the outer circumference of washer 30 is flattened as shown to cooperate with the flattened portion 58 of the second member 26. The retaining washer 32 is identical to washer 30 in all relevant aspects.

In use, the plugs 14 and 16 of the extension cords 10 and 12 are connected and placed adjacent the interior surface 44 of second member 26 as shown in FIG. 3. The retaining washer 30 is then positioned in the second member 26 so that the cable of extension cord 10 is slid into slot 88 and the washer 30 engages the groove 56 permitting the washer 30 to be most closely positioned adjacent the back side of plug 14. The flattening portion 92 of washer 30 cooperates with the flatened portion 58 of groove 56 to prevent the washer 30 from rotating once engaged with groove 56. The retaining washer 32 is similarly positioned within second member 26 with the cable of extension cord 12 being slid into slot 88 and washer 32 engaging the slot 56 permitting washer 32 to be positioned closest to the back end of plug 16.

The first and second members 24 and 26 are then pivoted together about hinge 28 to form a capsule as shown in FIG. 2. It is clear that the retaining washers 30 and 32, cooperating with the grooves 54 and 56 within the first and second members 24 and 26, prevent the plugs 14 and 16 from being disconnected. Therefore, the plugs will not be disconnected when tension is inadvertently or intentionally placed on either extension cord 10 or 12 during use. The offset of axis 50 and 52, and resultant offset of retaining washers 30 and 32 from central axis 42 and 48 induce a slight curvature in the cables of both extension cords 10 and 12. This provides additional resistance to motion of the plugs 14 and 16 when tension is applied to an extension cord. The curved surfaces 64 and 66 are in abutting relationship to define circular ports for passage of the cables of the extension cords 10 and 12. The compound curvature of the surfaces 64 and 66 reduce wear on the cable entering housing 18.

One significant advantage of the present invention is that the retaining washers 30 and 32 may be selectively positioned within grooves 54 and 56 to adapt the housing 10 for use with plugs 14 and 16 having varied lengths. One device constructed in accordance with the teachings of this invention is adjustable for use with plug up to 5 inches in length and having a width up to 1 5/8 inches. Another significant advantage of the present invention, as previously noted, is the streamline exterior shape which prevents housing 18 from being entangled with an obstruction. A further advantage found in the preferred embodiment of the present invention, formed of injection molded plastic, is the relatively light weight and strength of housing 18, having only three separate components, the integral first and second members 24 and 26 and hinge 28 and retaining washers 30 and 32.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A housing for maintaining the interconnection between the plugs on a pair of extension cords comprising:

a first member having a generally elongate hemicylindrical shape about a first central axis, the interior surface of said first member defining a plurality of spaced apart C-shaped grooves spaced along said interior surface of said first member in the elongate direction extending generally perpendicular to the first central axis;

a second member having a generally elongate hemicylindrical shape about a second central axis, the interior surface of said second member defining a plurality of spaced apart C-shaped grooves spaced along said interior surface of said second member in the elongate direction extending generally perpendicular to the second central axis;

A hinge member interconnecting said first and second members along edges in the elongate direction, said first member having at least one flexible means adjacent external edge for engaging said second member adjacent its external edge to secure said first and second members in abutting relationship to form a capsule for enclosing the plugs of the extension cords, the grooves of each of said first and second members being aligned along the elongate direction; and first and second retaining washers, each of said retaining washers being engagable with aligned grooves in said first and second members to secure said retaining washers therein when said first and second members are in abutting relationship and each having a slot formed therein for passage of a cable of an extension cord, said first and second retaining washers being positioned on opposite sides of the interconnected plugs of the extension cords within said first and second members to prevent disconnection of the plugs, said first and second retaining washers being selectively engagable with selected ones of the grooves in said first and second members to permit the use of said housing with plugs of varied lengths.

2. The housing of claim 1 wherein said first and second members and said hinge member are formed as an integral member, said hinge member being a living hinge.

3. The housing of claim 1 wherein the ends of said first and second members are tapered toward their central axes so that when said first and second members are in abutting relationship, said housing has a streamline shape.

4. The housing of claim 3 wherein the outer ends of said first and second members define a port for passage of the cable of an extension cord when said first and second members are in abutting relationship, the port being curved in two dimensions to prevent wear on the cable.

5. A housing for maintaining the interconnection between the plugs on a pair of extension cords comprising:

a first member having a generally elongate hemicylindrical shape about a first central axis, the interior surface of said first member defining a plurality of grooves spaced along said first member in the elongate direction extending generally perpendicular to the first central axis;

a second member having a generally elongate hemicylindrical shape about a second central axis, the interior surface of said second member defining a plurality of grooves spaced along said second member in the elongate direction extending generally perpendicular to the second central axis;

a hinge member interconnecting said first and second members along edges in the elongate direction, said first member having at least one flexible hook adjacent its external edge for engaging said second member adjacent its external edge to secure said first and second members in abutting relationship to form a capsule for enclosing the plugs of the extension cords, the grooves of each of said first and second members being aligned along the elongate direction; and first and second retaining washers, each of said retaining washers being engagable with aligned grooves in said first and second members to secure said retaining washers therein and each having a slot formed therein for passage of a cable of an extension cord, said first and second retaining washers being positioned on opposite sides of the interconnected plugs of the extension cords within said first and second members to prevent disconnection of the plugs, said first and second retaining washers being selectively engagable with the grooves in said first and second members to permit the use of said housing with plugs of varied length, a portion of the outer circumference of said first and second retaining washers defining a flat surface for cooperation with a flattened portion of the groove in said second member to prevent the first and second retaining washers from rotating when engaged with said groove.

6. A housing for maintaining the interconnection between the plugs on a pair of extension cords comprising:

a first member formed in a generally elongate hemicylindrical shape about a first central axis, the interior surface of said first member defining a series of grooves in the elongate direction generally perpendicular to the first central axis, the ends of said first member tapering toward the first central axis of said first member to define a semi-circular port;

a second member formed in a generally elongate hemi-cylindrical shape about a second central axis, the interior surface of said member defining a series of grooves in the elongate direction generally perpendicular to the second central axis, the ends of said second member tapering toward the second central axis of said second member to define a semi-circular port;

a hinge member interconnecting elongate edges of said first and second members, said first and second members and said hinge member being formed as an integral structure so that said hinge member forms a living hinge, said first member further having at least one flexible hook adjacent its opposite edge for engaging said second member adjacent the opposite edge of said second member to secure said first and second members in abutting relationship to form a capsule for enclosing the plugs of the extension cords, the grooves of each of said first and second members being aligned along the elongate direction and the semi-circular ports of said members being aligned to define circular ports for passage of the cables of the extension cords; and first and second retaining washers, each being engagable with aligned grooves in said first and second members to secure the washer therein and each having a slot formed therein for passage of a cable on an extension cord, said retaining washers being positioned on opposite sides of the interconnected plugs of the extension cords to prevent the disconnection of the plugs, said first and second retaining washers further being positioned so that the portion of the cables of the extension cords passing through the slots of said retaining washers is offset to resist movement of the plugs within said housing, said retaining washers being selectively engagable with the grooves so that said housing is adaptable for use with a range of plug lengths, said first and second retaining washers having a portion of their outer circumference formed into a flat surface for cooperating with a portion of the grooves also defining a flat surface to prevent rotation of said retaining washers within said first and second members.

* * * * *